US009194200B2

(12) United States Patent
Orstad

(10) Patent No.: US 9,194,200 B2
(45) Date of Patent: Nov. 24, 2015

(54) APPARATUS AND METHOD FOR CUTTING AND PULLING OF A CASING

(71) Applicant: Leif Invest AS, Kleppe (NO)

(72) Inventor: Leif Orstad, Kleppe (NO)

(73) Assignee: Leif Invest AS, Kleppe (NO)

( * ) Notice: Subject to any disclaimer, the term of this patent is extended or adjusted under 35 U.S.C. 154(b) by 100 days.

(21) Appl. No.: 14/351,795

(22) PCT Filed: Nov. 8, 2012

(86) PCT No.: PCT/NO2012/050217

§ 371 (c)(1),
(2) Date: Apr. 14, 2014

(87) PCT Pub. No.: WO2013/073949

PCT Pub. Date: May 23, 2013

(65) Prior Publication Data

US 2014/0231087 A1 Aug. 21, 2014

(30) Foreign Application Priority Data

Nov. 15, 2011 (NO) ..... 20111569
Oct. 31, 2012 (NO) ..... 20121273

(51) Int. Cl.
*E21B 29/00* (2006.01)
*E21B 31/20* (2006.01)
(Continued)

(52) U.S. Cl.
CPC ..... *E21B 29/002* (2013.01); *E21B 7/18* (2013.01); *E21B 23/00* (2013.01); *E21B 31/00* (2013.01); *E21B 31/16* (2013.01); *E21B 31/20* (2013.01); *E21B 29/005* (2013.01)

(58) Field of Classification Search
CPC ..... E21B 31/16; E21B 23/00; E21B 31/20; E21B 29/002; E21B 31/00; E21B 29/005
See application file for complete search history.

(56) References Cited

U.S. PATENT DOCUMENTS 2,481,637 A 9/1949 Yancey
4,047,568 A * 9/1977 Aulenbacher ..... E21B 23/00 166/216

(Continued)

FOREIGN PATENT DOCUMENTS

GB 2461639 1/2010
JP 2010189952 A * 9/2010

(Continued)

OTHER PUBLICATIONS

International Search Report for PCT/NO2012/050217 dated Jun. 2, 2013.

(Continued)

*Primary Examiner* — Zakiya W Bates
(74) *Attorney, Agent, or Firm* — Andrus Intellectual Property Law, LLP

(57) ABSTRACT

An apparatus and method are for cutting and pulling of a casing in a well. The apparatus comprises a housing connected to a wired connection, a cutting tool arranged in connection with the housing, where said cutting tool is rotatable around the longitudinal axis of the housing and arranged to be able to provide at least one cut-out in the wall of the casing and to be able to cut the casing, and a holding device for controlled holding of the housing in the casing. The apparatus is provided with at least one radially displaceable gripping means arranged to go into engagement with the at least one cut-out in the wall of the casing. The method comprises bringing the apparatus down into the well; positioning the apparatus in order to carry out a first cut; carrying out the first cut; positioning the apparatus in order to carry out a second cut; carrying out the second cut; one of the first cut and the second cut comprising cutting of the casing; bringing at least one gripping means into engagement with at least one of the first and the second cut; and pulling the cut casing out of the well by means of the apparatus.

21 Claims, 20 Drawing Sheets

(51) Int. Cl.

| | |
|---|---|
| ***E21B 31/16*** | (2006.01) |
| ***E21B 31/00*** | (2006.01) |
| ***E21B 7/18*** | (2006.01) |
| ***E21B 23/00*** | (2006.01) |

(56) References Cited

U.S. PATENT DOCUMENTS

| | | | | | |
|---|---|---|---|---|---|
| 4,969,514 | A * | 11/1990 | Morris | E21B 31/20 | 166/55 |
| 5,318,115 | A * | 6/1994 | Rouse | E21B 4/02 | 166/361 |
| 6,029,745 | A * | 2/2000 | Broussard | E21B 31/16 | 166/298 |
| 6,431,270 | B1 | 8/2002 | Angle | | |
| 6,626,074 | B1 | 9/2003 | Wheeler | | |
| 2002/0060076 | A1 * | 5/2002 | Harrell | E21B 29/005 | 166/340 |

FOREIGN PATENT DOCUMENTS

| | | |
|---|---|---|
| NO | 313156 | 8/2002 |
| WO | 9807955 | 2/1998 |
| WO | 9937877 | 7/1999 |
| WO | 2011031164 | 3/2011 |
| WO | 2011074981 A1 | 6/2011 |
| WO | 2011115941 A1 | 9/2011 |

OTHER PUBLICATIONS

Written Opinion for PCT/NO2012/050217 dated May 2, 2013.

* cited by examiner

APPARATUS AND METHOD FOR CUTTING AND PULLING OF A CASING

CROSS-REFERENCE TO RELATED APPLICATIONS

This application is the U.S. national stage application of International Application PCT/NO2012/050217, filed Nov. 8, 2012, which international application was published on May 23, 2013, as International Publication WO2013/073949 in the English language. The international application is incorporated herein by reference, in entirety. The international application claims priority to Norwegian Patent Application No. 20111569 and Norwegian Patent Application No. 20121273, which applications are incorporated herein by reference, in entirety.

FIELD

The present invention relates to an apparatus and a method for cutting and puffing of a casing in a well. More specifically the invention relates to an apparatus and a method allowing cutting and pulling of a casing in one operation.

BACKGROUND

On shutting down a well in the underground for example a petroleum well, or on drilling a slot recovery, it is necessary to cut and pull the casing. In order to carry out such cutting and pulling, it is known to use one tool for cutting and another tool for pulling. This is a time-consuming and therefore also costly operation.

Norwegian Patent No. 313156 discloses a tool for radial or diametrical cutting of metal pipework, in particular submerged submarine pipework and pipework forming parts of oil platform support structures, the cutting being performed by high pressure projection of abrasive particles suspended in a vector fluid. A tool for radial cutting of pipework using a pressurized abrasive jet may be accommodated inside of the pipework. The tool comprises a housing which may be immobilized inside of said pipework, and a rotary head provided with a nozzle for projecting water and abrasives, said body including a first and a second inflatable positioning ring, each of said inflatable rings being toroid and being constituted by an elastomeric membrane which defines a sealed cavity which is very flattened in cross section when deflated, and which has a thickness under pressure that is at least twice its deflated thickness. The tool according to said publication is used for cutting pipework forming the support structures of oil platforms on dismantling such platforms. When the cutting operation is finished, the cutting tool and the cut tube are lifted to the surface when lifting rings are inflated to cause cushions to bear against the inner wall of the tube. The engagement between the tool and the cut tube is thus dependent on the frictional engagement between these and of the integrity of the inflatable lifting rings.

SUMMARY

The invention has for its object to remedy or to reduce at least one of the drawbacks of the prior art, or at least to obtain a useful alternative to prior art.

The object is attained through features described in the description given below and in the following patent claims.

In a first aspect the invention more specifically relates to an apparatus for cutting and pulling of a casing in a well, where the apparatus comprises:

a housing connected to a wired connection;

a cutting tool arranged in connection to the housing, where said cutting tool is rotatable around a longitudinal axis of the housing and arranged to be able to provide at least one cut-out in the wall of the casing and to be able to cut the casing; and a holding device for controlled holding of the housing in the casing; the apparatus being provided with at least one radially displaceable gripping means arranged to go into engagement with the at least one cut-out in the wall of the casino.

Cutting tool in this connection means a tool arranged to be able to out through the pipe wall. The cutting tool may be of type known per se, as for instance, but not limited to, a hydraulic cutting tool.

The wired connection may contain pipes and wires for transmission of fluid and signals. The wired connection may for example be a so-called umbilical.

The combination of the cutting tool and the holding device has the effect that the apparatus in accordance with the invention may be used for cutting and pulling of pipes, for example casings, in one operation by means of one tool. Time and expenses related to pulling out one tool and thereafter running in another tool, are thus eliminated. Further the holding device provides a secure engagement between pipe and tool independent of the friction between the holding device and the inner wall portion of the casing. Thus the risk of relative movement between the apparatus and the casing is close to eliminated as the gripping means is led into engagement with the cut-out in the wall of the casing.

In one embodiment the cutting tool of the apparatus is displaceable relative to the housing in the longitudinal direction of the housing. This has the effect that the housing may be kept against movement at the same time as more cuts are made in the longitudinal direction of the casing, which again simplifies the process of positioning the apparatus.

In one embodiment the apparatus is further provided with a pressure intensifier which is located in the well. This has the advantage that the fluid need not be pressurized in for example a surface vessel. Loss of pressure which will occur in the cases where the fluid is brought down to great depths is thus reduced. In addition the safety risk represented by high pressure on board a vessel is minimized.

The pressure intensifier may be located inside the housing. This has the advantage that the pressure intensifier is protected by the housing and that the tool with the pressure intensifier may be handled as one unit. By arranging the pressure intensifier inside of the housing, the loss of pressure due to transmission distance, will be minimized.

In one embodiment the holding device comprises at least two radially displaceable holding pins arranged to be able to protrude from a portion of the housing. The pins are preferably, but not necessarily, arranged at a mutually equal distance in the circumference of the housing. The advantage of this is that the apparatus will be kept stable and in the right position while cutting is performed.

In another embodiment the holding device comprises at least one set of radially displaceable holding pins arranged to be able to protrude from a portion of the housing, each set comprising at least two radially displaceable holding pins. This has the advantage of keeping the apparatus stable and in the right position while cutting is performed.

In one embodiment the at least one gripping means comprises one or more radially displaceable gripping pins arranged to be able to protrude from a portion of the housing and to be led into the at least one cut-out in order to provide a secure engagement between the cut casing and the apparatus such that secure pulling of the cut casing is provided.

In one embodiment the at least one gripping means comprises one or more radially displaceable gripping pins arranged to be able to protrude from a portion of an extension of the housing. This has the effect that the cut off portion of the casing may be pulled inwards by means of the gripping means, without getting into conflict with the housing.

In the embodiments where the gripping means comprises several radially displaceable gripping pins, it is advantageously if these are distributed along the circumference of the housing or along the circumference of the extension of the housing. The radially displaceable gripping pins may be arranged substantially evenly distributed along the circumference of the housing or along the circumference of the extension of the housing. This has the advantage that the grip is stable and the load is evenly distributed. In the embodiments where the gripping means is arranged in the extension of the housing, said distribution of gripping pins will facilitate contraction of the pipe sections. The contraction is necessary in order for the cut-off casing to be pulled out of the well through intact casing.

In one embodiment the at least one gripping means which protrudes from an extension of the housing comprises at least one net of gripping pins. In this embodiment one set of gripping pins comprises four gripping pins where pairs of gripping pins are arranged along the same axis, but oppositely directed. The four gripping pins thus constitute two pairs of gripping pins where the longitudinal axes of the pairs are arranged at an intermediate angle, where said angle may be, for example, but not limited to, 90 degrees. The effect of arranging the gripping pins as mentioned above, is that the cut casing may be cut in the longitudinal direction into four pipe sections in such a way that the diametrically opposite gripping pins grip the diametrically opposite pipe sections, as two pipe sections at a time may be pulled in and thus make possible the pulling out of portions of casing positioned below intact casing.

In one embodiment the housing is further provided with an axially displaceable portion such that the extension of the tool in the longitudinal direction may be varied. This has the advantage that the apparatus may be kept in one position while the displaceable portion makes it possible to perform more cuts in the longitudinal direction of the pipe as well as in the circumference of the pipe, for example said cut-outs and cutting of the casing. This presupposes that the holding pins are provided in a "stationary" portion of the apparatus while the cutting tool is provided in the axially displaceable portion of the apparatus.

In one embodiment the apparatus in accordance with the invention comprises at least two sets of holding pins, one set comprising two or more radially displaceable holding pins of which at least one set of pins is arranged on either side, in the longitudinal direction, of the axially displaceable portion, and each of the sets is arranged to be able to be led in and out of contact with the pipe wall in such a way that one set of pins always is in engagement with the wall while the displaceable portion is being so moved, such that the apparatus provides for a "caterpillar movement". This has the advantage that the apparatus may be moved stepwise in the longitudinal direction of the casing.

In one embodiment the apparatus comprises a collecting container provided below the gripping pins in the extension of the housing. This has the effect that cut off and contracted pipe sections may be dropped down into said collecting container and collected there before the container is pulled out together with the apparatus. In this way more pipe sections may be cut off before it is required to pull the apparatus out of the well.

In further embodiments the apparatus comprises two or more cutting tools arranged in series in the longitudinal direction of the well. This has the effect that the apparatus may be tailor-made in a most appropriate combination of one or more cutting tools following each other or alternately together with the apparatus's one or more gripping means, in each case, and thereby increasing the range and capacity of the apparatus.

In a second aspect of the present invention a method for cutting and pulling of a casing by use of the apparatus in accordance with the first aspect, is provided, the method comprising the following steps:

- to bring the apparatus down into the well:
- to position the apparatus in order to carry out a first cut;
- to carry out the first cut;
- to position the apparatus in order to carry out a second cut;
- to carry out the second cut; one of the first cut and the second cut comprising cutting of the casing;
- to lead at least one gripping means into engagement with at least one of the first and the second cut; and
- to pull the cut casing out of the well by means of the apparatus.

By positioning is here understood that the apparatus is arranged in the desired position and is clamped there by means of a holding means.

By leading at least one gripping means into engagement with at least one of the first and the second cut, a secure connection between the apparatus and the cut casing is provided, which enables safe and quick pulling of said cut casing out of the well.

The apparatus, and thereby also the cut casing, is pulled up by means of tools of known type, like a hoisting gear.

The advantage of said method is that cutting and pulling of a casing may be carried out in one single operation. In addition the gripping means and cut-outs in the wall of the casing provide a secure connection which anyhow is easily releasable when the pipe and the apparatus get out of the well. The apparatus is thus rapidly ready for a new operation.

In accordance with the method, the first cut may comprise providing at least one cut-out in the wall portion of the casing, and the second cut comprises cutting of the casing. This has the effect that the at least one gripping means may be brought into engagement with the at least one cut-out even before the casing is cut. In an alternative method the first cut may comprise providing said cutting of the casing and the second cut may comprise providing the at least one cut-out in the wall portion of the casing.

In a third aspect of the present invention a method for cutting and pulling of a casing by means of the apparatus in accordance with the first aspect of the invention, the so method comprising the following steps:

- to bring the apparatus down into the well;
- to position the apparatus in order to carry out at least one first cut;
- to carry out the at least one first cut;
- to position the apparatus in order to carry out at least one second cut;
- to carry out the at least one second cut; one of the at least one first cut and the at least one second cut comprising peripheral cutting of the casing and the second of the at least one first cut and the at least one second cut comprising longitudinal cutting of the casing;
- to position the apparatus in order to carry out at least two third cuts;

to carry out the at least two third cuts; the at least two third cuts comprising cutting of at least two fingers;

to bring the at least two gripping means into secure engagement with the at least two third cuts by pushing the at least two fingers out and bringing the gripping means into engagement with the edge of the cut casing;

to retract the at least two gripping means while the secure engagement with the walls of the casing is maintained so that also the walls of the casing are pulled inwardly;

to pull the cut casing out of the well by means of the apparatus.

In order to separate that part of the casing which is to be removed from the remaining pipe, one or two peripheral cuts must be made. In cases where the part of the casing which is to be pulled out is the upper part of the casing or a part of the casing which verges on a void wherefrom the casing has already been removed, only one peripheral cut will be necessary. In other cases where the part of the pipe which is to be removed does not already have an end portion, two peripheral cuts are necessary.

To perform at least one, advantageously two or four, longitudinal cuts from the at least one peripheral cut to the end of the portion of the pipe or to a second peripheral cut, respectively, has the effect that pipe sectors are separated from each other. The longitudinal cut or cuts has/have advantageously an angle unlike 90 degrees in relation to the inner surface of the pipe, such that the cut surfaces may be displaceable relative to each other upon contraction.

Cutting of at least two fingers has the effect that the gripping means of the apparatus may be brought against said fingers and push them outwards towards the wall of the well to provide secure engagement between said gripping means and the wall of the cut casing. It should be understood that the execution of said first, second and third cut may be carried out in any order.

Retraction of the at least two gripping means while they are securely engaged with the wall of the cut casing, has the effect that the wall of the cut casing is contracted and split up in accordance with the longitudinal cut or cuts. The contraction of the wall of the cut casing allows pulling the cut casing out of the well, even if there is still intact casing above the position of the cut.

The positioning of the apparatus in order to carry out the at least one second cut may be provided by displacing a cutting tool relative to a housing comprised by the apparatus, while the housing is kept from movement in the casing. The effect of this is that the at least one second cut is carried out at a distance from the first cut, the distance being limited by the range of the cutting tool.

Alternatively the positioning of the apparatus in order to carry out at least one second cut is provided by displacing the apparatus in the casing. This may be attained by raising or lowering the apparatus by means of the cabled connection, for example the umbilical. An advantage of positioning the apparatus the said way is that a larger range is attained and the distance between the first and second cut is thus less limited.

Even a further way to position the apparatus for carrying out the second cut, may be provided by displacing the apparatus by means of a "caterpillar movement". Such caterpillar movement may be attained by further providing the apparatus with an axially displaceable portion which by means of a driving means may provide extension and shortening of the apparatus, and by means of a holding device comprising at least two sets of radially displaceable holding pins where at least one set of holding pins is provided on either side in the longitudinal direction of the axially displaceable portion, and with a control device arranged to be able to control each of the pairs of pins alternately to bear against the wall of the pipe while the displaceable portion is extended and shortened. The advantage of said method is that the position and movement of the apparatus may be calculated completely accurate in advance. By moving the apparatus in the pipe by said caterpillar movement, exact positioning of the apparatus may be provided.

According to the invention the apparatus may be further provided with a collecting container in front of the gripping means. After the gripping means has pulled the cut casing together as described above, the gripping means may be released from the cut casing which thereafter falls down into said collecting container. This has the effect that more pipe sections may be cut off and collected before it is necessary to pull out the apparatus. It must be understood that it is also possible to pull out the cut casing without any collecting container by maintaining the gripping means' grip of the cut casing and pull it out of the well.

BRIEF DESCRIPTION OF THE DRAWINGS

In the following an example of a preferred embodiment which is illustrated in the enclosed drawings, is described, where.

DETAILED DESCRIPTION OF THE DRAWINGS

Figure 1:
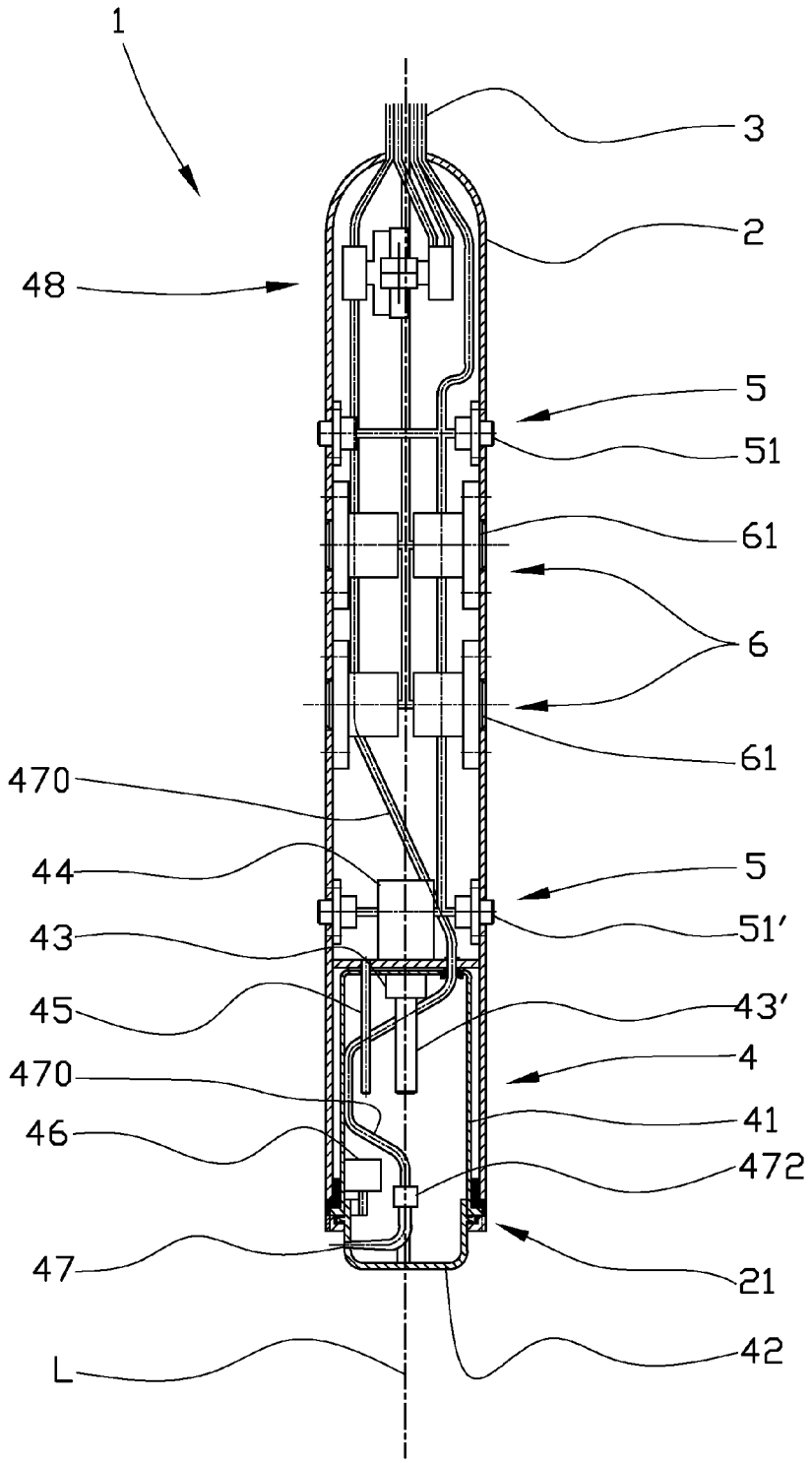
FIG. 1 shows a cross section of an apparatus for cutting and pulling of a casing.

Equal or equivalent elements are indicated with the same reference number in the figures.

Indications of position and orientation as for instance upper, lower, above, below, vertical and horizontal refer to the position shown in the figures.

In the figures the reference number 1 indicates an apparatus for cutting and pulling of a casing.

The apparatus 1 comprises a housing 2 which is connected to a wired connection 3, here shown as a so-called umbilical 3 of type known per se protruding from an upper portion of the housing 2. The umbilical 3 may for example extend to a not shown surface vessel and may be used for transferring fluids, electricity and control signals to the apparatus 1.

A cutting tool 4 is movably arranged in a lower portion of the housing 2. The cutting tool 4 is arranged to be able to be displaced along the longitudinal axis L of the housing 2 and to be able to be rotated about the longitudinal axis of the cutting tool 4. In the shown embodiment the longitudinal axis of the cutting tool 4 is coaxial to the longitudinal axis L of the housing 2. The longitudinal axis L is shown in FIG. 1 only.

The cutting tool 4 includes a cutting tool housing 41 and a rotation portion 42.

The cutting tool housing 41 is in an upper end portion provided with a fixedly arranged nut 43. The nut 43 is arranged coaxially to the longitudinal axis of the cutting tool housing 41, which in the shown embodiment is congruent with the longitudinal axis L of the housing 2, and with a cut-out in the upper end portion of the cutting tool housing 41.

A threaded spindle 43' is complementary adapted to the nut 43 such that rotation of the spindle 43' may provide displacement of the cutting tool 4 relative to the housing 2 along the longitudinal axis L.

A spindle motor 44 of type known per se is connected to the spindle 43'. The spindle motor 44 may for example be an electrically driven motor or a fluid driven motor. This is however not specifically shown in the enclosed figures, as both types of motors would be known to a person skilled in the art.

The cutting tool housing 41 is kept from rotation by means of a guiding apparatus 45 in the form of a rod body extending from a portion of the housing 2 and in through an adapted cut-out in the cutting tool housing 41. In an alternative embodiment (not shown) a guiding means is provided in a portion of the housing defined by an annulus between the inner surface of the housing 2 and the outer surface of the cutting tool housing 41.

The rotation portion 42 is rotatably connected to a lower portion of the cutting tool housing 41 by means of a rotation fastening point 21 of type known per se. The rotation portion 42 is arranged to be rotated by means of a rotation motor 46 of type known per se. The rotation motor 46 may for example be an electrically driven motor, or else it may be a fluid driven motor. This is however not shown in the enclosed figures of the same reasons as explained for the spindle motor 44.

A nozzle 47 for a pressurized fluid has its outlet in a side portion of the rotation portion 42. The nozzle 47 is connected to a fluid supply line 470 through a sliding coupling 472 of type known per se. Abrasives, for example, may be added to the fluid. In the following the fluid will also be referred to as abrasive fluid.

The abrasive fluid is supplied through the umbilical 3. In the shown embodiment the apparatus 1 is provided with a pressure intensifier 48 arranged to be able to raise the pressure of the fluid which is emitted from the nozzle 47 and which is arranged to be able to provide the cuts in the casing. The pressure intensifier 48 is especially useful when the apparatus 1 is used at great depths of the ocean where the pressure drop as a consequence of the transfer loss in the umbilical 3 is considerable. By arranging the pressure intensifier 48 in the apparatus 1, namely in close proximity to the location of so use, it is not necessary to provide a pressure for example on board a vessel which has to be considerably larger than the pressure necessary to provide cutting in the well. A high pressure on board a vessel would represent a safety risk.

In order to provide the desired pressure in the cutting fluid, typically 3000-4000 bars, it is with the proposed apparatus 1 only necessary to add driving oil that drives the pressure intensifier 48, a moderate pressure, typically 200 bars, at the surface. The problems related to high pressures at the surface will thus be eliminated or at least considerably reduced.

The movement of the cutting tool 4 relative to the housing 2 is controlled in a per se known manner from for example the surface vessel by means of per se known means.

Figure 6:
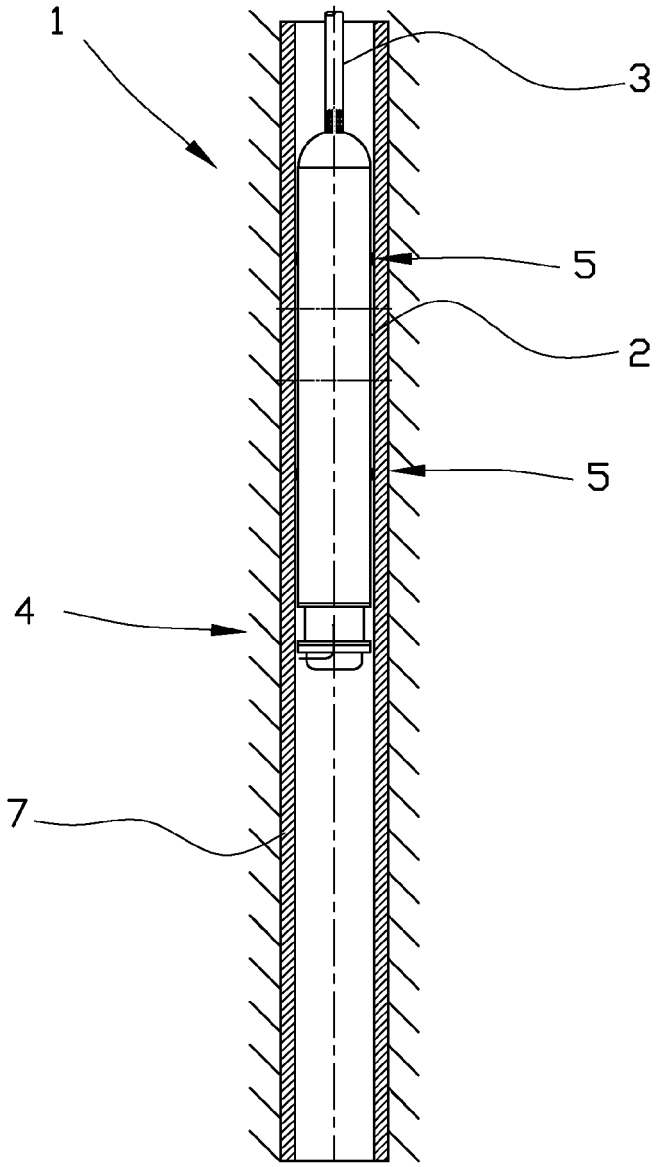
FIG. 6 shows, in a smaller scale, a cross section of an apparatus as it is run into a casing in a well.

The apparatus 1 further comprises a holding device 5 for fixing the housing 2 in a casing 7 as shown for example in FIG. 6.

The holding device 5 comprises in the shown embodiment two pairs of pins, which in the following are denoted holding pins 51, 51'. It should however be understood that the holding device 5 alternatively may have another design. Said holding pins 51, 51' are arranged for radially displacement out of the housing 2 and to bear against the wall of the casing 7 and thus provide fixing of the apparatus 1 for example while cutting is performed by the cutting tool 4.

It should be understood that the number of holding pins 51, 51' may differ from the four shown here. It should also be understood that the holding pins 51, 51' may be arranged differently from the diametrical position shown.

The apparatus 1 is further provided with a gripping means 6 in the form of at least one, but generally more, pins 61 arranged for protruding from the housing 2 and for engagement with cut-outs provided in the casing 7 by means of the cutting tool 4, which will be discussed further in the following. Said pins 61 will in the following be denoted gripping pins 61.

In the FIGS. 1-5 the apparatus 1, as an example, is shown with gripping means 6 comprising four gripping pins 61.

It should be understood that the number of gripping pins 61 may be another than the four that are shown. It should also be understood that the gripping pins 61 may be arranged differently than the diametrical position shown.

The gripping means 6 is in the shown embodiment controlled by means of a fluid. The fluid may for example be hydraulic oil which is controlled from for example a surface vessel.

In FIG. 1 the gripping pins 61 are shown in a retracted or deactivated position, a position that is maintained until cut-outs arranged to be able to receive the gripping pins 61, are provided in the casing 7.

Figure 2:
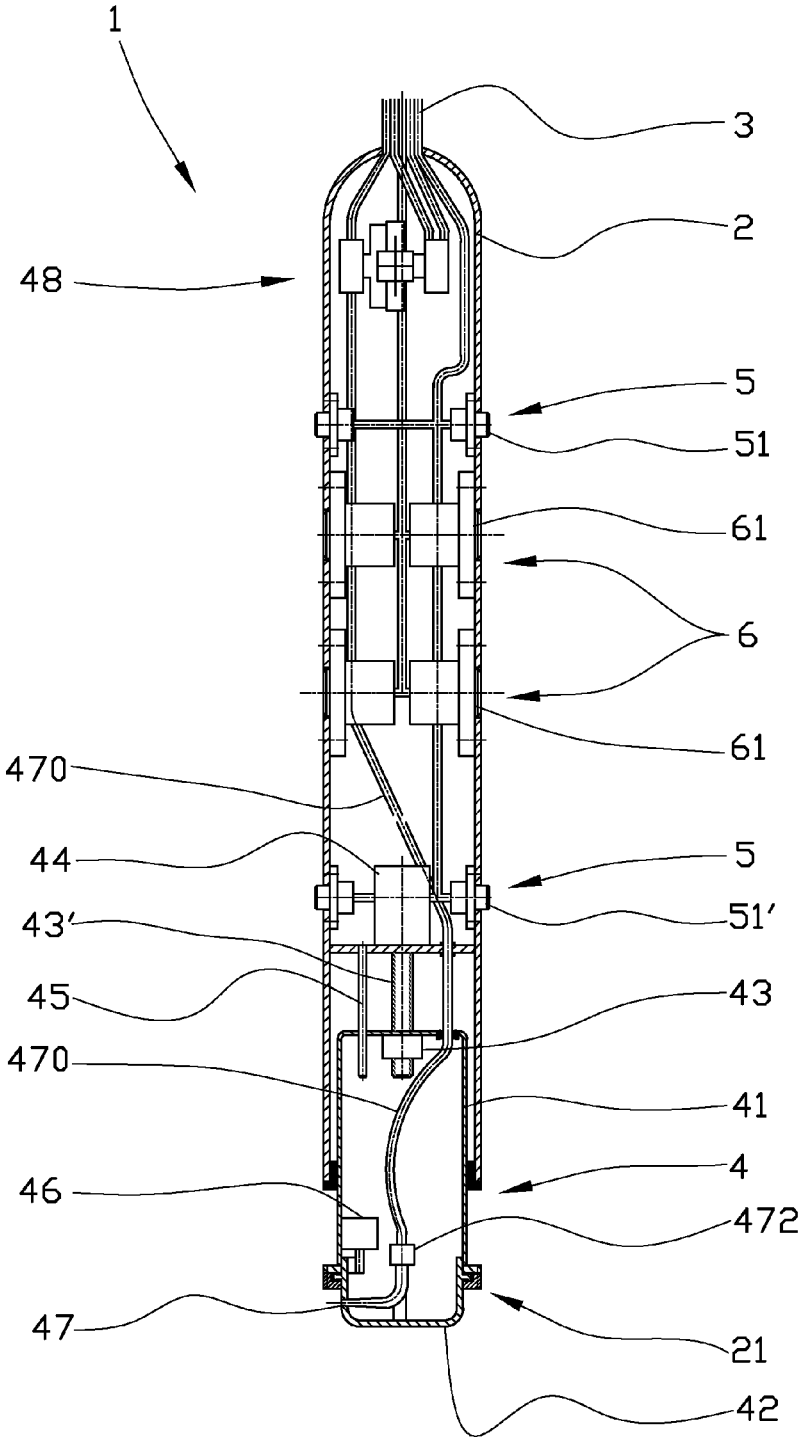
FIG. 2 shows the apparatus of FIG. 1, but where the cutting tool is in an extended position.

FIG. 2 shows the apparatus 1 with the cutting tool 4 in an extended position, that is after the spindle motor 44 has rotated the spindle 43' and thus displaced the cutting tool 4 to the close to maximum extended position as shown in FIG. 2. The mechanism for displacing the cutting tool 4 in the longitudinal direction of the apparatus 1 provides possibilities to make more cuts along the longitudinal axis L of the apparatus 1 while the apparatus 1 is continuously kept fixed by means of the holding device 5.

However, it should be understood that the apparatus 1 may comprise more cutting tools 4 arranged in series in the longitudinal direction of the well, whereby the range of the apparatus 1 increases.

It should be understood that the apparatus 1 may also be released from the fixed position in the casing 7 and be displaced along the longitudinal axis L of the apparatus 1 before the apparatus 1 again is fixed in the casing 7 and one or more new cuts are provided.

Figure 3:
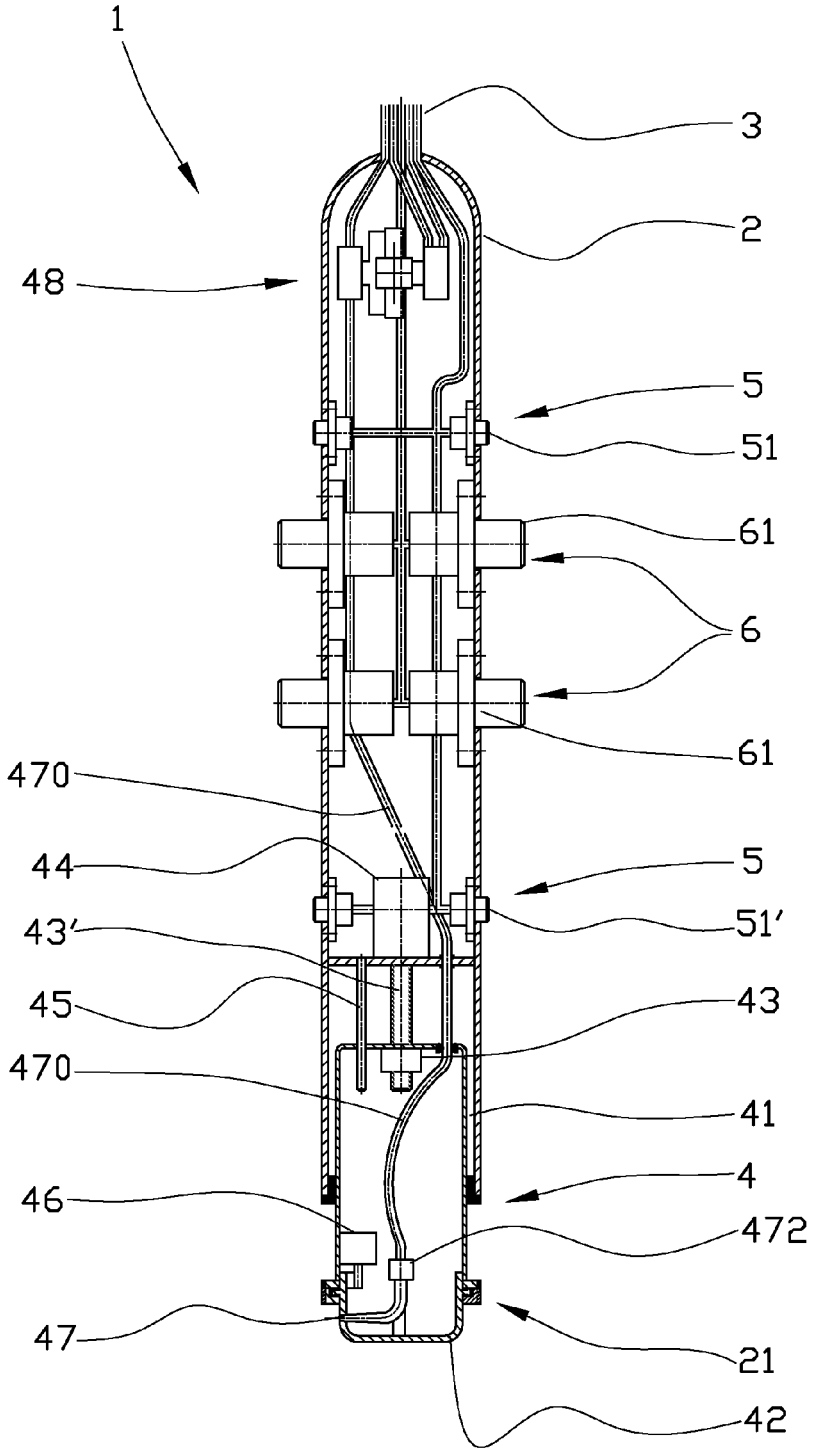
FIG. 3 shows the apparatus of FIG. 2, but where gripping means are shown in an activated state.
Figure 9:
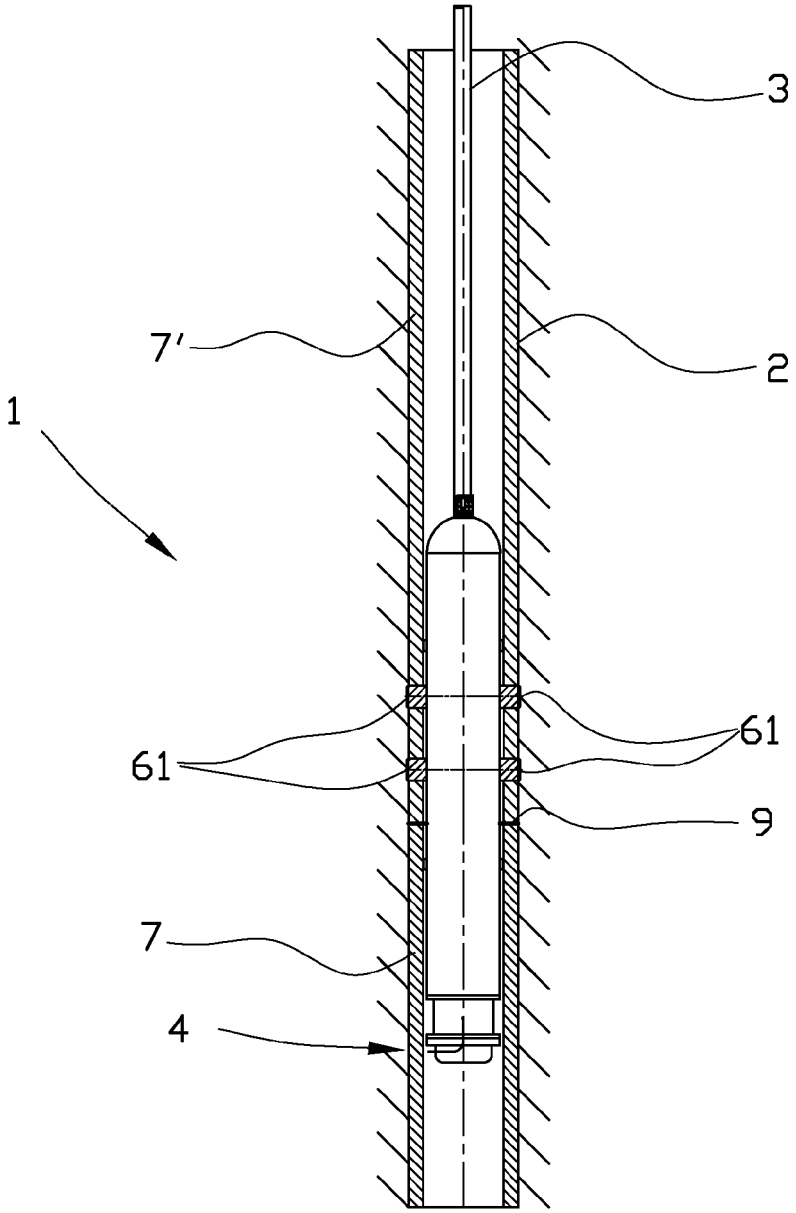
FIG. 9 shows the apparatus of FIG. 8 after having brought the gripping means into engagement with the cut-outs in the wall of the casing.

FIG. 3 shows the apparatus 1 with the cutting tool 4 still in an extended position and the gripping means 6 in an activated position, a position that is required while the gripping pins 61 are in engagement with cut-outs 8 in the wall of the casing 7 as shown in FIG. 9.

Figure 4:
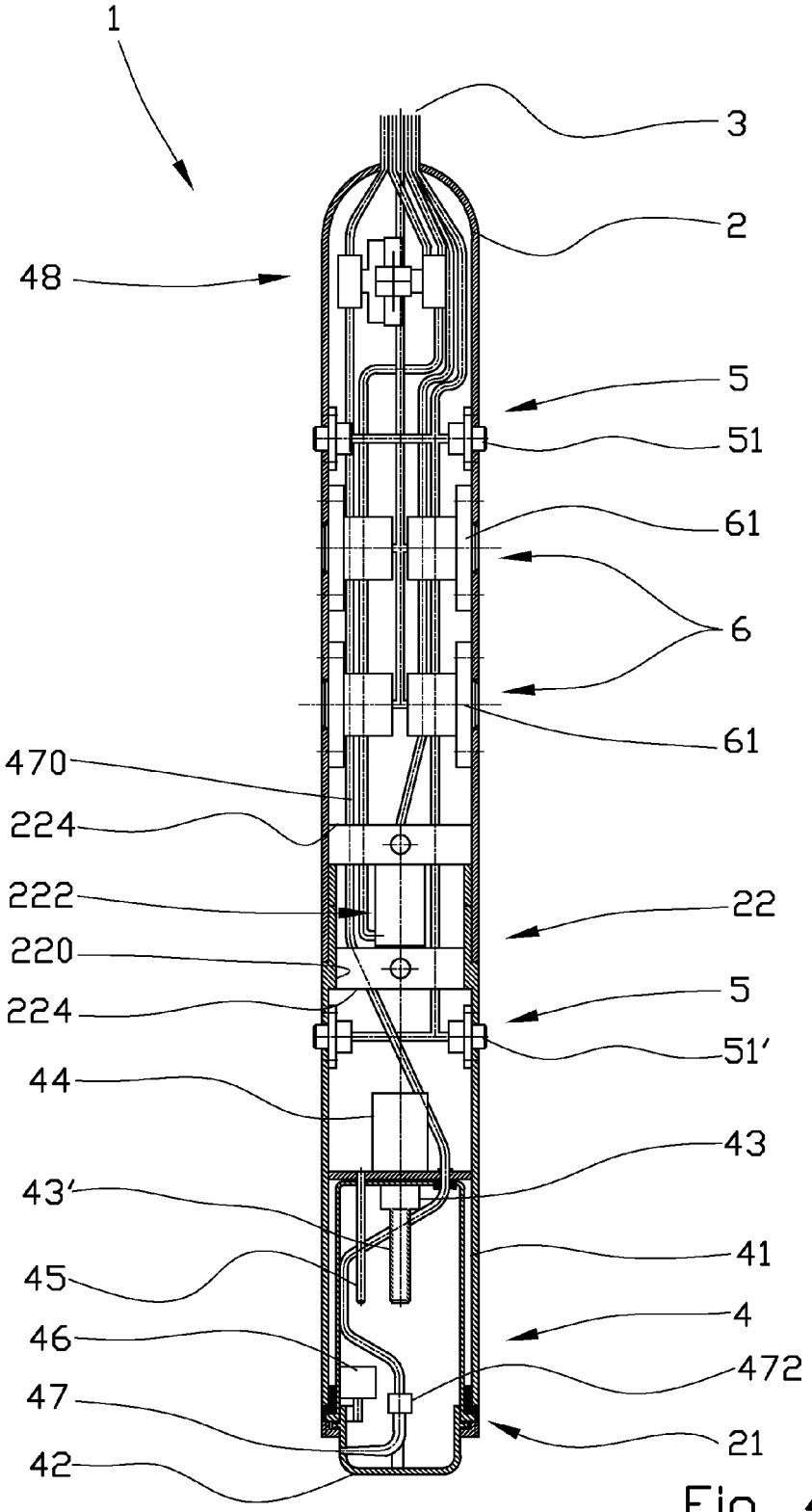
FIG. 4 shows a cross section of an apparatus for cutting and pulling, where the apparatus is further provided with an axially displaceable portion.

FIG. 4 shows an alternative embodiment of the apparatus 1, where the housing 2 is provided with an axially displaceable portion 22.

The axially displaceable portion 22 comprises a telescopic body 220 constituting a telescopic portion of the housing 2. The axial displacement is provided by means of a linear actuator known per se, here shown as a hydraulic cylinder arrangement 222 connected to the housing 2 by means of support bodies 224 fixedly connected to the housing 2. The cylinder arrangement 222 is controlled by means of a hydraulic fluid so supplied through the umbilical 3.

The axially displaceable portion 22, in combination with the holding device 5 consisting of two sets of holding pins 51, 51', one set of holding pins 51, 51' being positioned on either side, in the longitudinal direction, of the axially displaceable portion 22, makes it possible to move the apparatus 1 in "caterpillar movement". This caterpillar movement results from letting the two sets of holding pins 51, 51' alternately being activated and deactivated, while the axially displaceable portion 22 at the same time is being extended and shortened. More specifically, the caterpillar movement results from first activating the upper set of holding pins 51 and deactivating the lower set of holding pins 51', while the axially displaceable portion 22 is extended. Thereafter the lower set of holding pins 51' is activated, the upper set of holding pins 51 is deactivated and the axially displaceable portion 22 is retracted. The apparatus 1 has now moved one step downwards. This process may be repeated in order to move the apparatus 1 further downwards, or it may be reversed, that is extending the axially displaceable portion 22 while the lower set of holding pins 51' is activated, and retract the axially displaceable portion 22 after having activated the upper set of holding pins 51, in order to move the apparatus 1 step by step upwardly in the pipe.

Figure 5:
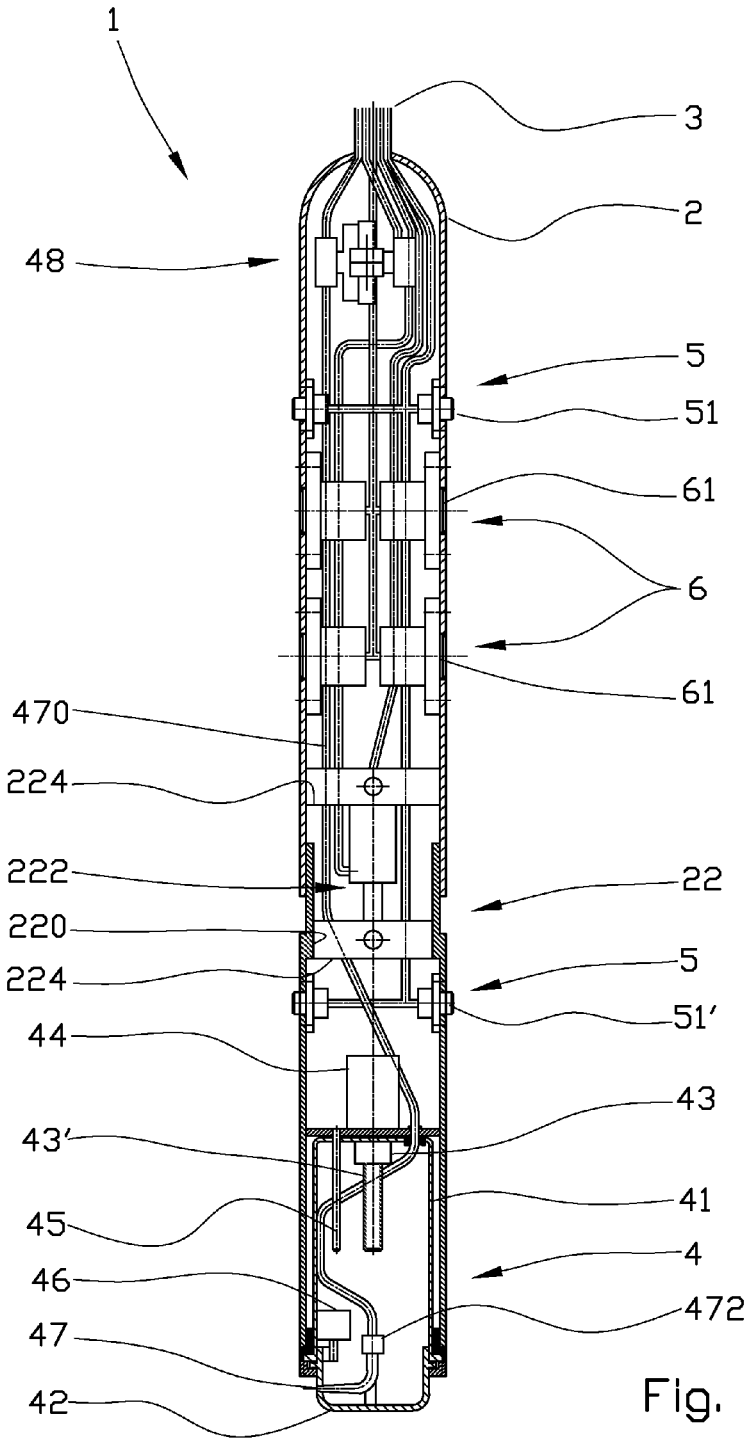
FIG. 5 shows the apparatus of FIG. 4, but where the axially displaceable portion is shown in an extended position.

FIG. 5 shows the same alternative embodiment of the apparatus 1 as FIG. 4, but with the difference that the axially displaceable portion 22 is shown in an extended position.

The FIGS. 6-11 show the apparatus 1 in a smaller scale, after having been brought into a casing 7 in a well.

FIG. 6 shows the apparatus 1 on its way down a casing 7 which is to be cut and pulled up by means of the apparatus 1. As the apparatus 1 is in movement the holding pins 51, 51' are in a partly withdrawn position such that the holding pins 51, 51' function as guides or centring devices for the apparatus 1 instead of a holding device for fixed holding of the apparatus 1. The holding pins 51, 51' could also be arranged completely retracted in the housing 2 as the apparatus 1 is run into the well, but that might result in scraping of the outer surface of the housing 2 against the inner surface of the casing 7 and thus lead to wear and tear of the housing 2.

Figure 7:
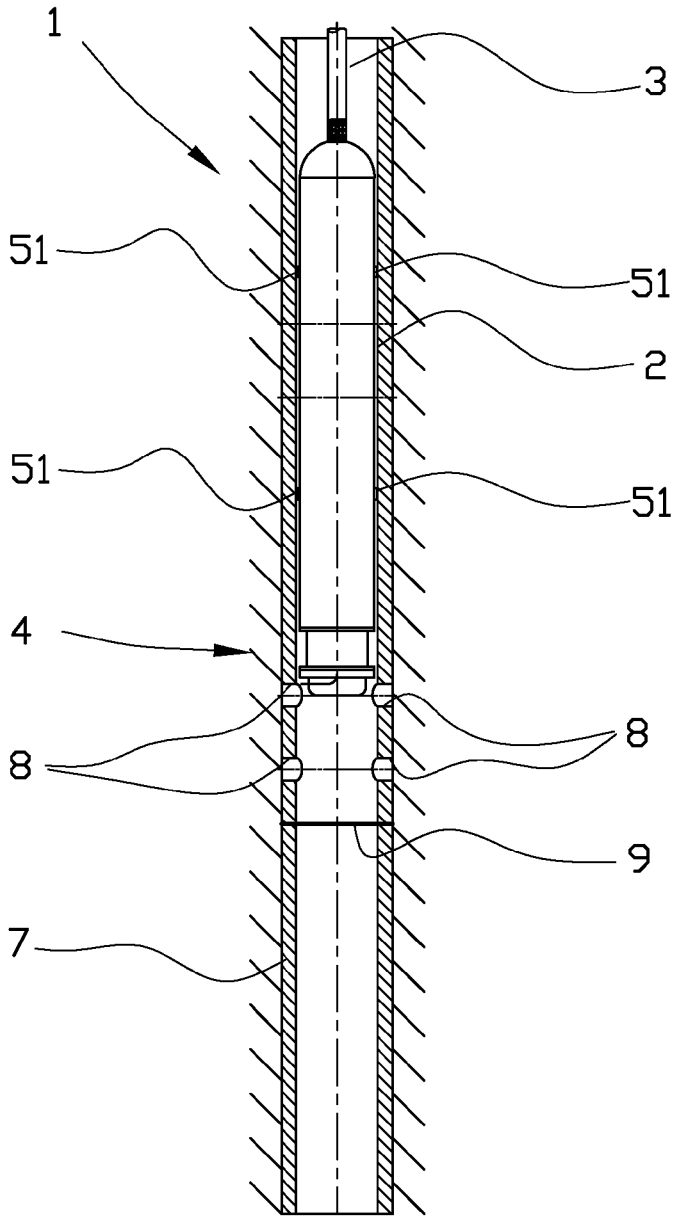
FIG. 7 shows a cross section of the apparatus in a casing, where the cutting of a section and four cut-outs are performed.

FIG. 7 shows the apparatus 1 after more cuts have been made by means of the cutting tool 4, namely cut-outs 8 in the wall of the casing 7, in the figure shown as four, and a cut 9 of the casing 7. In the shown embodiment the cut 9 has been made as the cutting tool 4 was in an extended position (as shown in FIG. 2). Thereafter the cutting tool 4 is partly retracted into the housing 2 after which the two lower of the four cut-outs are provided. Finally the cutting tool 4 is retracted into the housing 2, but not further than the cutting tool will still be able to be displaced sufficiently to provide the two upper cut-outs which extend in the longitudinal direction of the casing 7.

Figure 8:
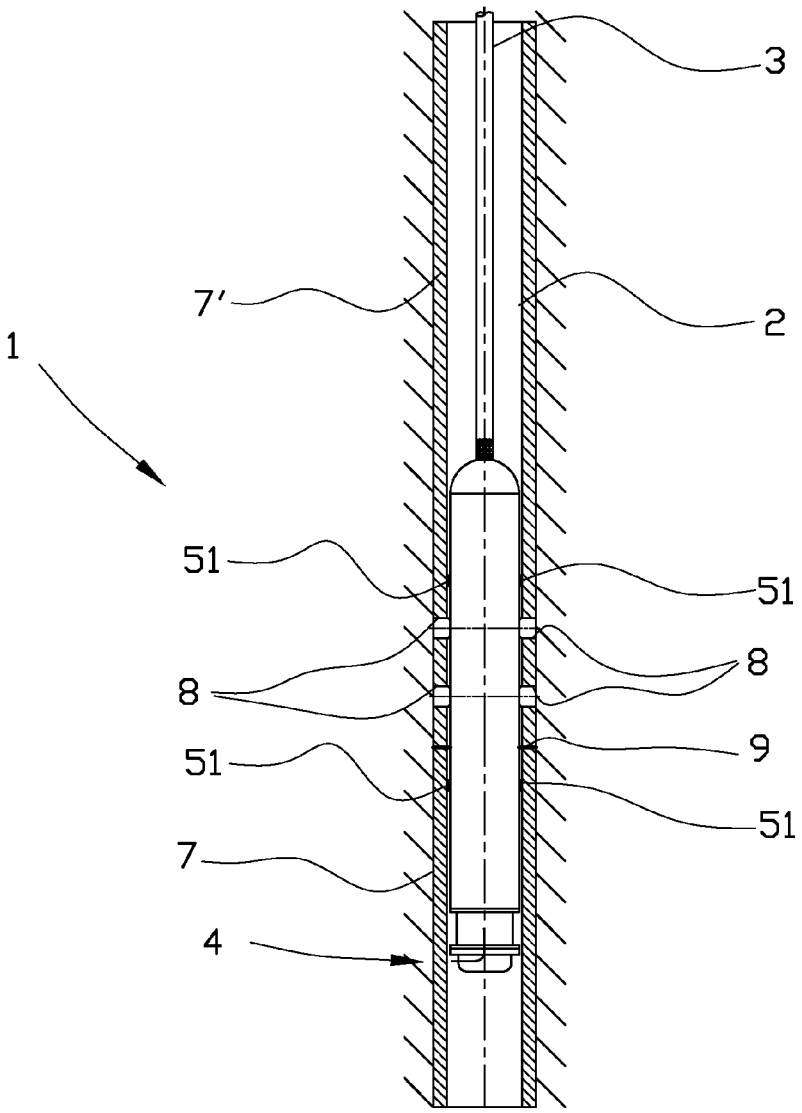
FIG. 8 shows the apparatus of FIG. 7 brought into position to let the gripping means be led into the cut-outs in the wall of the casing.

FIG. 8 shows the apparatus 1 run down to such a position that the gripping pins 61 are positioned such that they correspond to the cut-outs 8, but where the gripping pins 61 are in their retracted position as shown in FIG. 1.

FIG. 9 shows the apparatus 1 in the same position as shown in FIG. 8, but after the gripping pins 61 are brought to their extended position (as shown in FIG. 3) and into the cut-outs 8 in order to provide a secure connection between the apparatus 1 and the portion of the casing 7 which is to be pulled out. This portion of the casing 7 is denoted with the reference number 7' in the figures.

Figure 10:
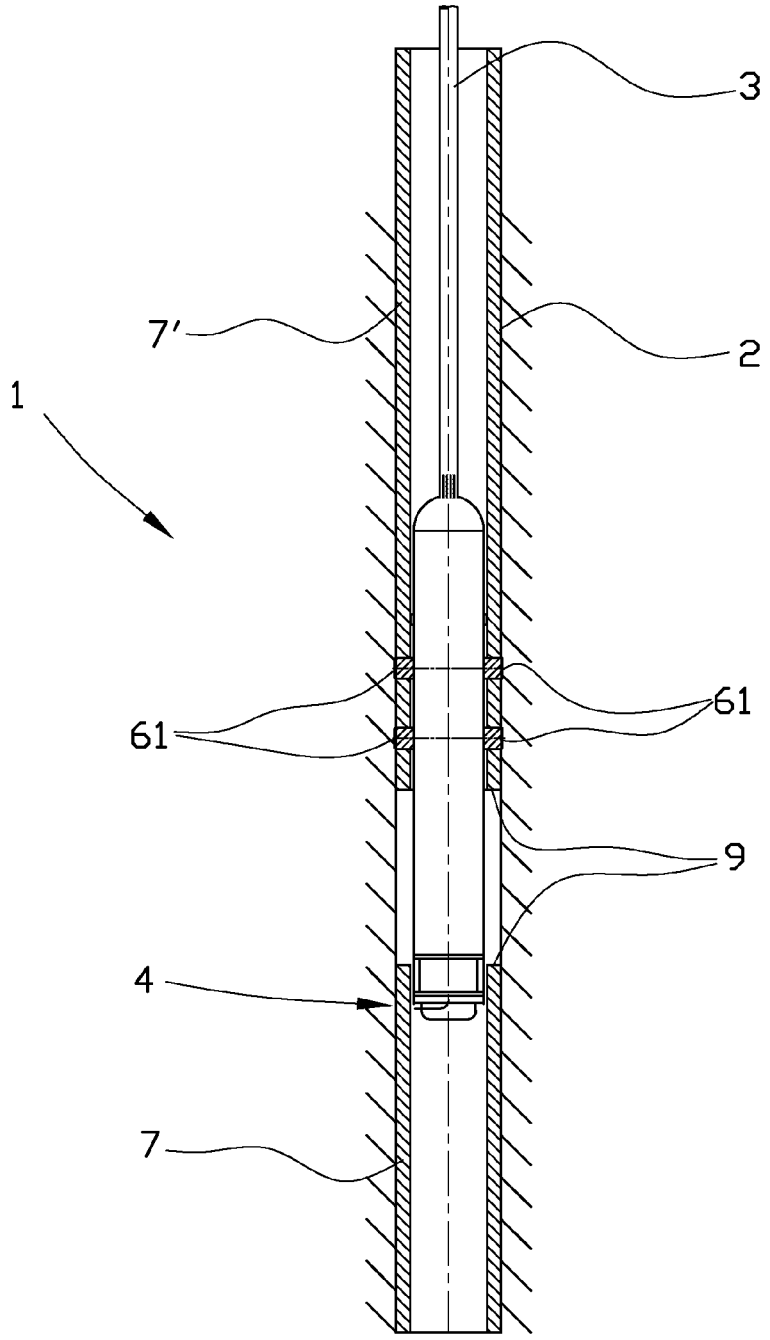
FIG. 10 shows the apparatus of FIG. 9 as the apparatus is pulling the cut casing out of the well.

FIG. 10 shows the apparatus 1 as the apparatus 1 by means of the gripping pins 61 and a not shown hoisting mechanism of known type, is pulling the cut casing 7' up.

Figure 11:
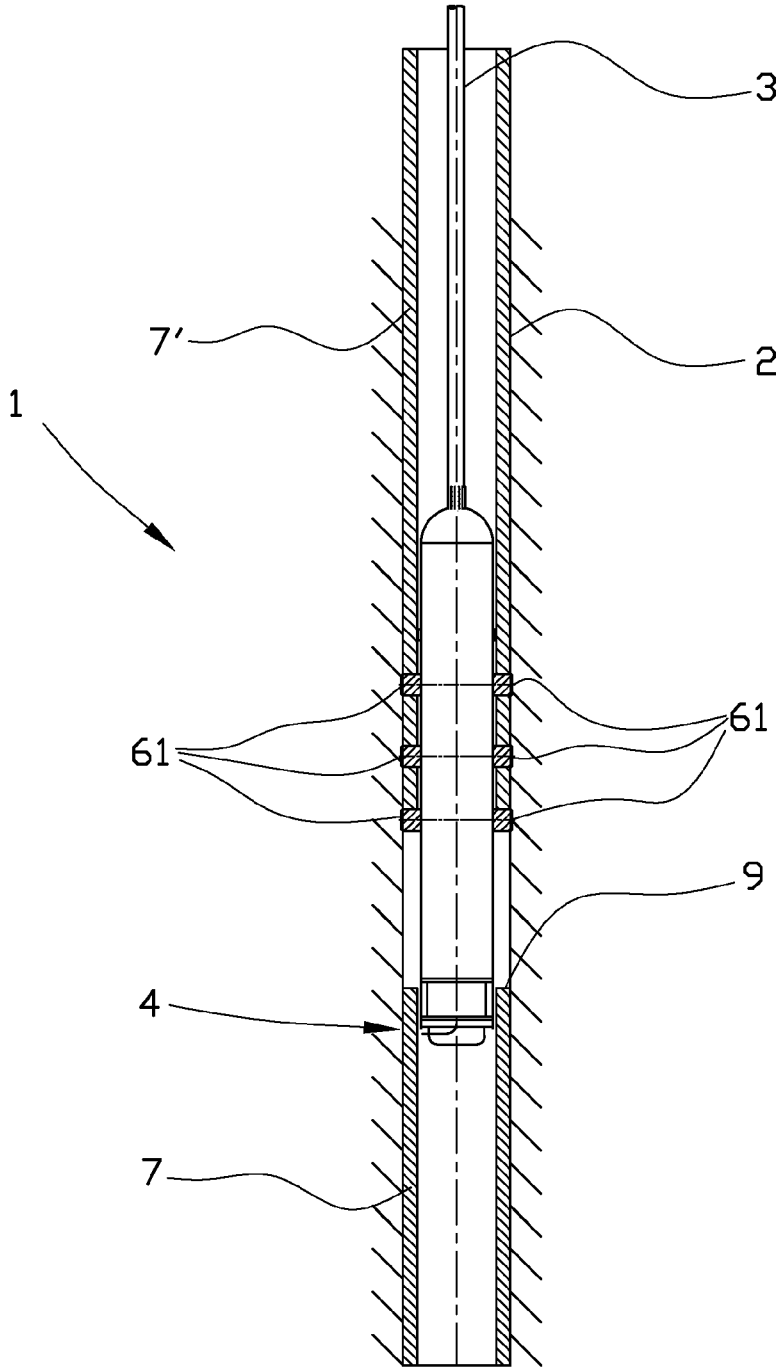
FIG. 11 shows a cross section of an apparatus for cutting and pulling, as said apparatus is pulling the cut casing out of the well and a third set of gripping means is brought into engagement with the end portion of the cut casing.

FIG. 11 shows the same as FIG. 10, but the apparatus 1 being provided with a further gripping means 6, for example in the form of yet another set of gripping pins 61, but not limited hereto, having gone into engagement beneath the lower end surface of the cut casing 7' as the apparatus 1 is hoisted. Such a further gripping means 6 entails an even more secure lift of the cut casing 7'.

After the apparatus 1 and the cut off casing 7' are brought to the surface, the apparatus 1 is released from the casing 7' simply by bringing the gripping pins 61 out of engagement with the casing 7' and possibly also retracting the holding pins 51, 51' out of contact with the inner circumferential surface of the casing 7'. Thus the apparatus 1 may easily and quickly be ready for use again.

Since the cut- and pull-operation is performed with one apparatus 1 only, the operation will be quick and thus economically beneficial. Additionally, the engagement of the gripping pins 61 with the cut-outs 8 of the casing 7, 7' provides a secure fastening of the apparatus 1 to the casing 7, 7', a fastening that will be able to withstand a tractive force which in one embodiment only reaches a limitation as the force from the gripping pins 61 provide a stress towards the edges of the cut-outs 8 that exceeds the yield stress of the casing material.

Figure 12:
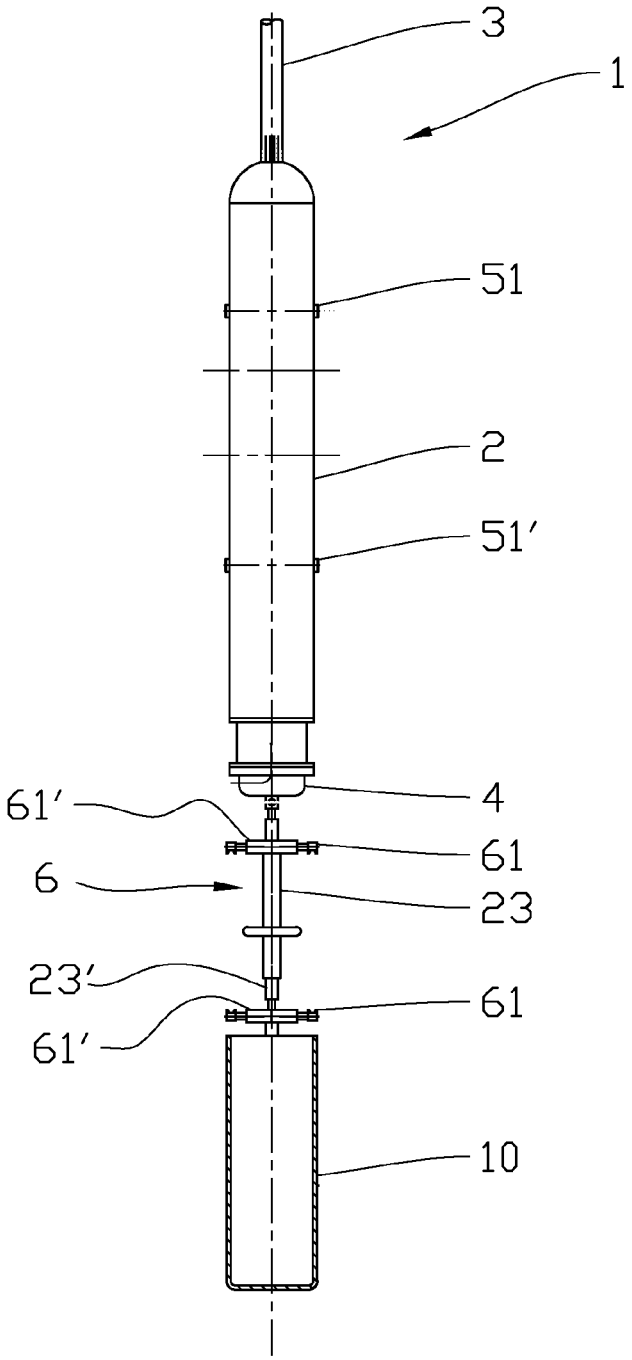
FIG. 12 shows a planar view of an apparatus for cutting and pulling, the gripping means of the apparatus being provided in connection with an extension of the housing, and the apparatus further being connected to a collecting container.

FIG. 12 shows an embodiment of the apparatus 1 where the gripping means 6 are provided in connection with an extension 23 of the housing 2 and where the apparatus 1 is further provided with a collecting container 10. The extension 23 of the housing 2 is further provided with a telescopic cylinder 23' arranged to be able to fasten and loosen the engagement of the gripping pins 61 with the edge of the casing 7'. Arranging the gripping means 6 below the housing 2 itself makes it possible to use the gripping means 6 to contract the cut off part of the casing 7' without getting into conflict with the housing 2. This again makes possible the cutting and pulling of portions of the casing 7' through intact casing 7 and further out of the well. The pulling of said cut off casing 7' may either be done by gripping pins 61 being in engagement with the casing 7' while the apparatus 1 and consequently the engaged casing 7' is pulled out, or more advantageously, by letting the cut casing 7' fail down into the collecting container 10. The former solution has the advantage of allowing the pulling of casings also in horizontal sections of the well. The latter solution allows cutting and collection of several portions of the casing 7 before it is necessary to pull the apparatus 1 and the collected, cut portions of the casing 7' out of the well.

Figure 13A:
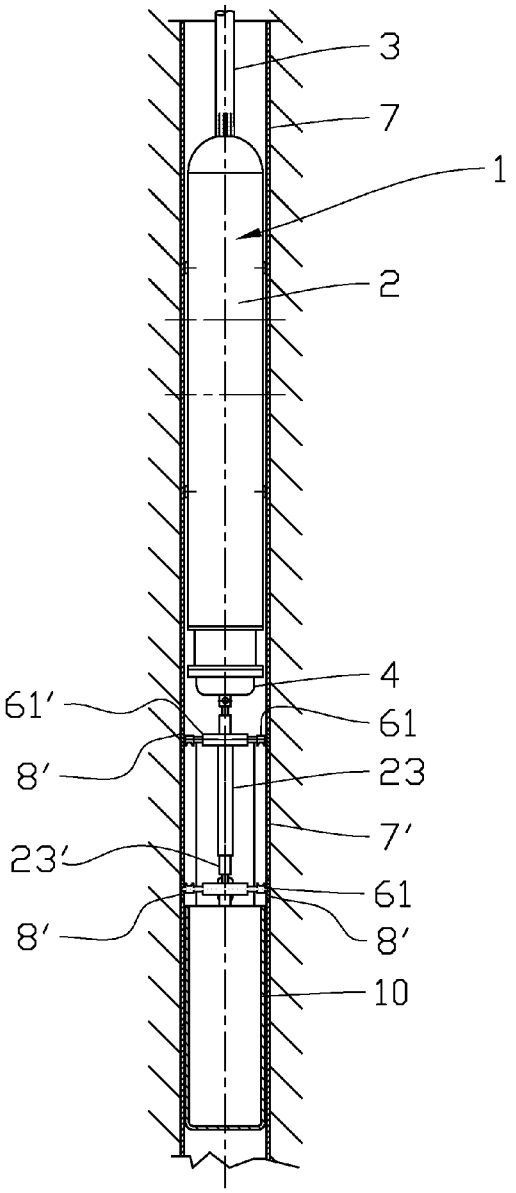
FIG. 13*a* shows the apparatus from FIG. 12, the apparatus being located in a well bore and four fingers being cut in the wall of the casing.
Figure 13B:
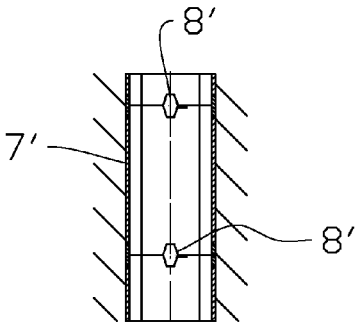
FIG. 13*b* shows a planar view of a segment of the cut casing wherein two fingers are cut out.

FIG. 13*a* shows the apparatus 1 in FIG. 12 inside a well. The gripping pins 61 abut against cut fingers 8' in the wall of the casing 7'. Said fingers 8' are shown perpendicular to the inner surface of the casing 7' in FIG. 13*b*.

The FIGS. 14-19 show the apparatus 1 in FIG. 12 and FIG. 13*a* inside of a well, through different phases of cutting and pulling of the casing 7'.

Figure 14:
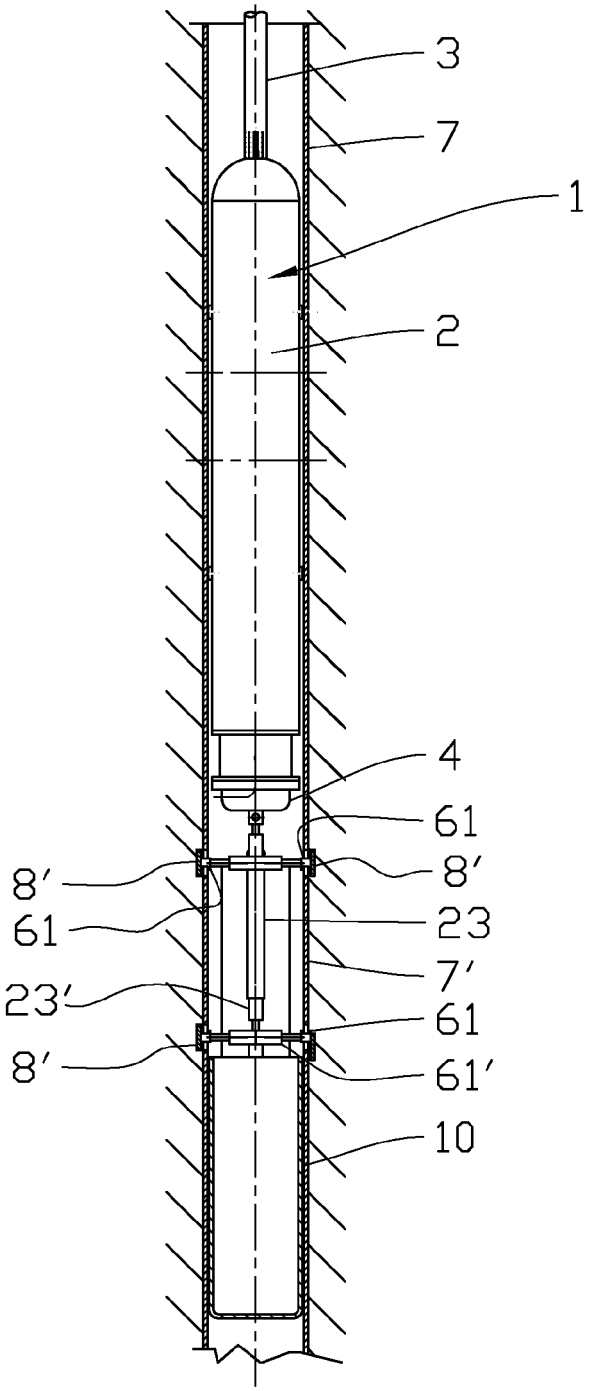
FIG. 14 shows the same as FIG. 13*a*, but the gripping means having pushed the cut fingers out.

In FIG. 14 the fingers 8' are pushed out by means of the gripping pins 61 which are arranged in an end portion of a telescopic arm 61' of type known per se. The extension and retraction of the arm 61' are typically driven by means of hydraulics. The opening or gripping width of the gripping pins 61 may be controlled the same way. The casing 7 is cut peripherally above the upper fingers 8' and below the lower fingers 8'. It should be understood that the casing 7 alternatively may be cut peripherally in connection with the upper fingers 8' and the lower fingers 8'.

Figure 15:
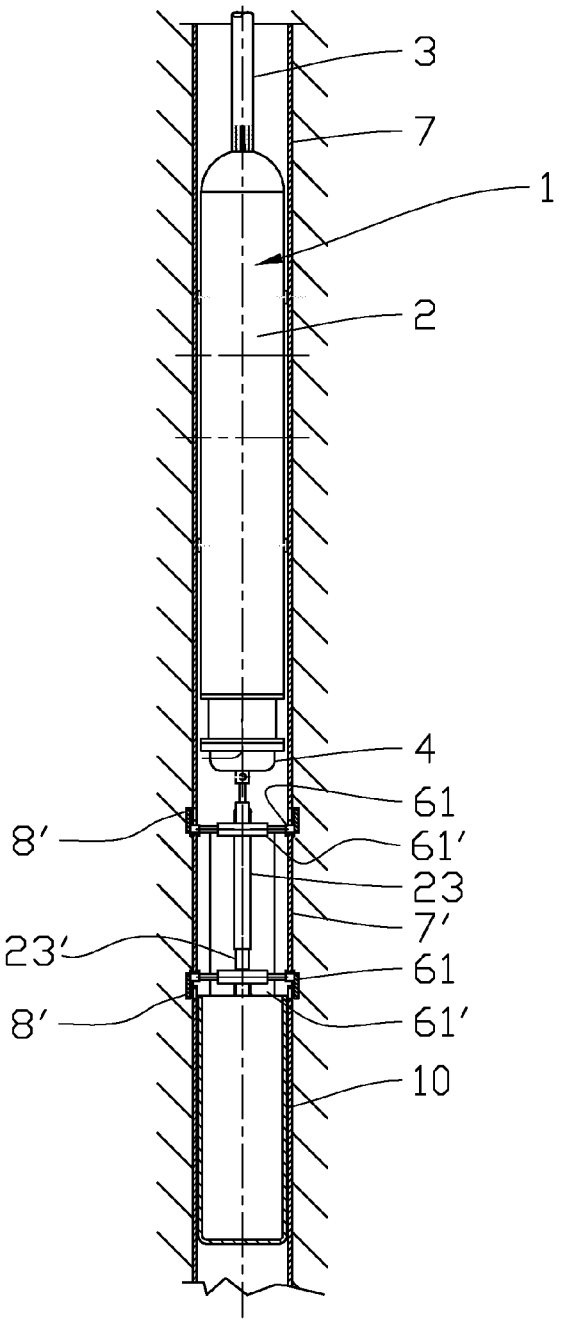
FIG. 15 shows the apparatus of FIG. 14, but where the gripping means have grasped the edges of the cut casing.

In FIG. 15 the gripping pins 61 are brought into secure engagement with the edge of the cut casing 7' where the fingers 8' are pushed out.

Figure 16:
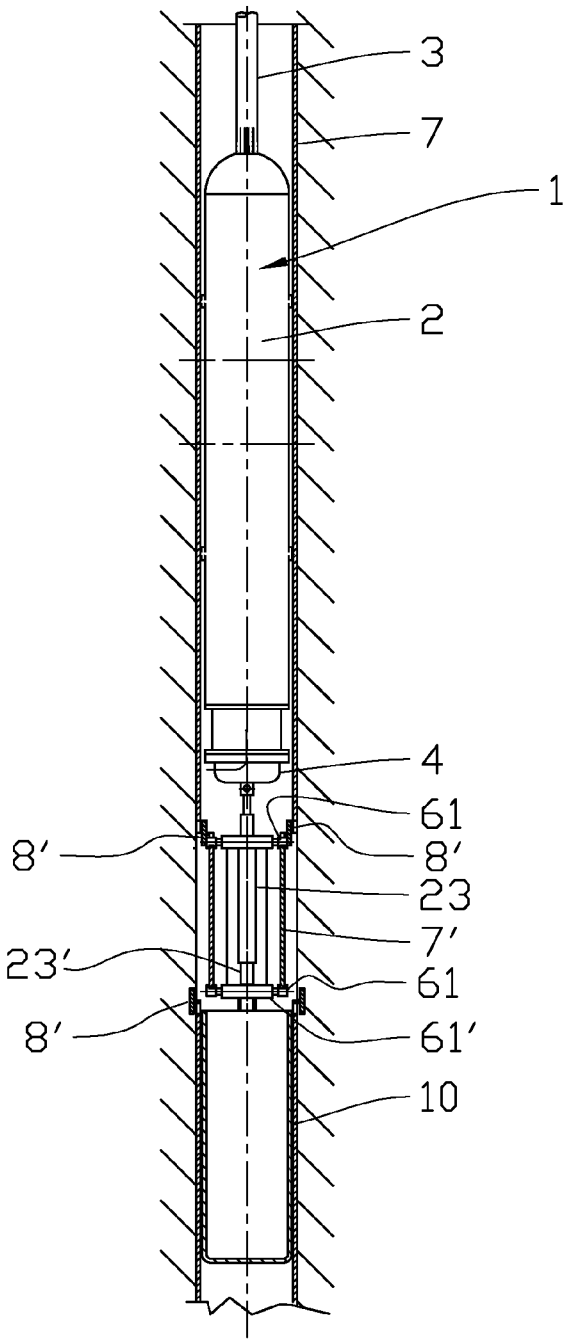
FIG. 16 shows the apparatus of FIG. 15, but where the gripping means are being withdrawn and have pulled along the cut casing.

FIG. 16 shows the apparatus 1 as the arm 61' and thus the gripping pins 61 are retracted radially at the same time as the engagement between the gripping pins 61 and the edge of the cut casing 7' is maintained. The cut casing 7' is thereby contracted to a diameter less than its original diameter.

The cut casing 7' may be pulled out of the well in two principally different ways.

A first way is to maintain the engagement of the gripping pins 61 with the casing 7' and pull it out of the well together with the apparatus 1.

Figure 17:
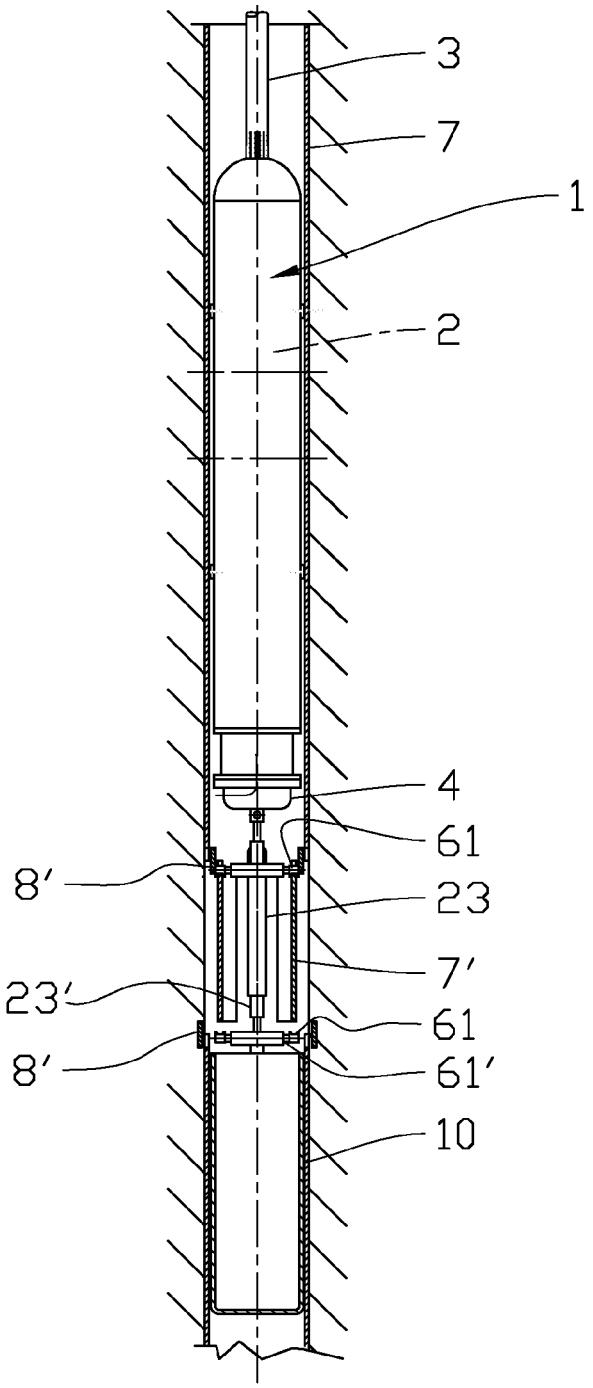
FIG. 17 shows the apparatus of FIG. 16, but where the lower gripping means are released from the cut casing, while the upper gripping means are still engaged with the cut casing.
Figure 18:
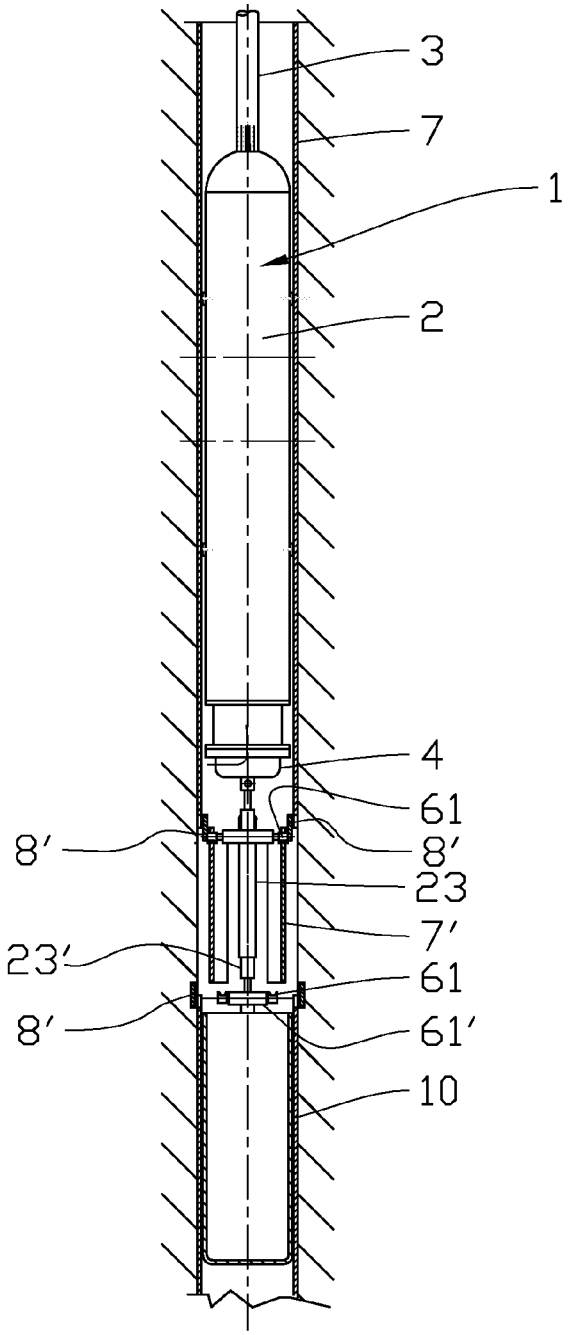
FIG. 18 shows the apparatus of FIG. 17, but where the lower gripping means are further withdrawn.
Figure 19:
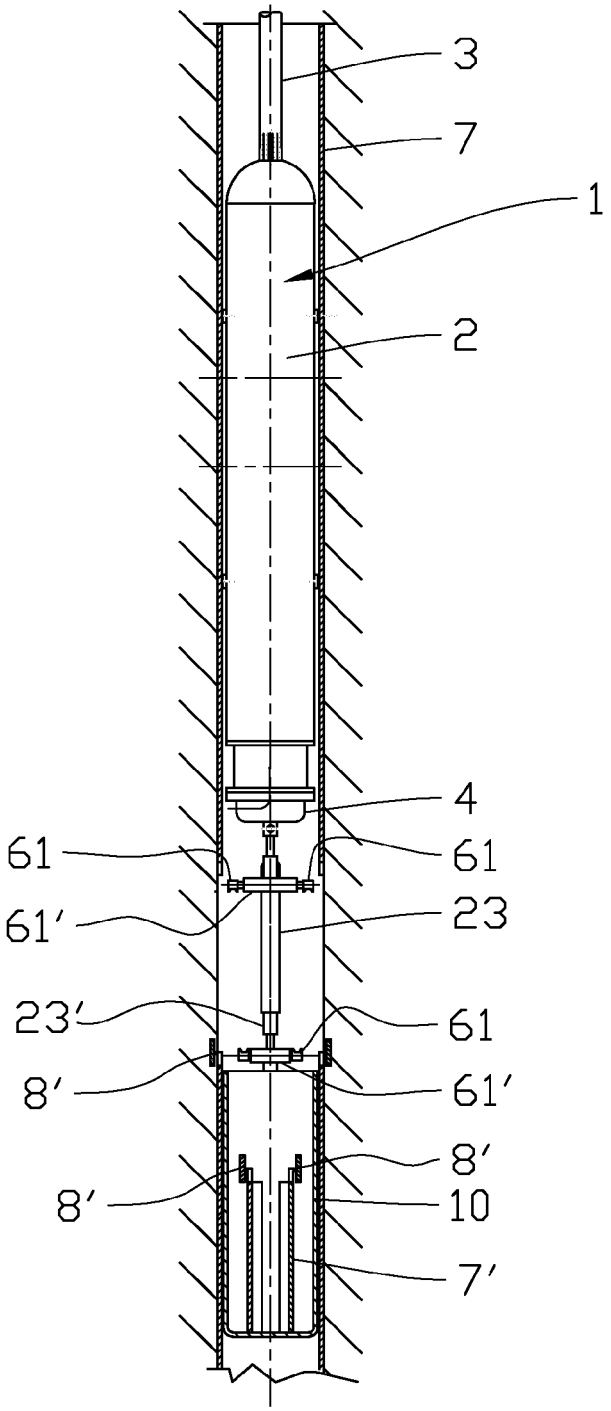
FIG. 19 shows the apparatus of FIG. 18, but where the upper gripping means are also released from the engagement with the cut casing and the cut casing has fallen down into the collecting container.

A second, alternative way, as shown in FIG. 17, is to release the lower gripping pins 61 from their engagement with the casing 7'. The lower gripping pins are released by extending the telescopic cylinder 23'. The upper gripping pins 61 are still in secure engagement with the edge of the casing 7'. The lower gripping pins 61 are thereafter retracted further in, as shown in FIG. 18, before the upper gripping pins 61 are released and the cut casing 7' is allowed to fall down into the collecting container 10, as shown in FIG. 19. This way several lengths of the casing 7 may be cut before the apparatus 1 is pulled out. The number of cut lengths of casing 7' is dependent on the length of the collecting container 10 and the positioning of the pipe segments relative to each other inside of the collecting container 10, amongst other things. One way to fit more pipe segments into the container 10 is to pull the cut casing 7' a little more together every time a new segment is cut off, and thus make the cut casing segments fit inside of each other in the container 10. Another possibility is to make more longitudinal cuts in the cut casing 7' so that the pipe segments may be packed closer together in the container 10. The two methods mentioned above may also be combined.

The FIGS. 20*a*-20*d* show the gripping means 6 from above in a cross section of the casing 7 after performing the four longitudinal cuts of the casing 7' whereby the casing 7' is divided in four pipe sections 71. The gripping means 6 are here shown in the form of four gripping pins 61 arranged in end portions of radially displaceable arms 61' where the arms 61' in pairs have the same longitudinal axis, but where each of the arms 61' protrudes from the centre portion of the gripping means 6 in opposite directions.

Figure 20A:
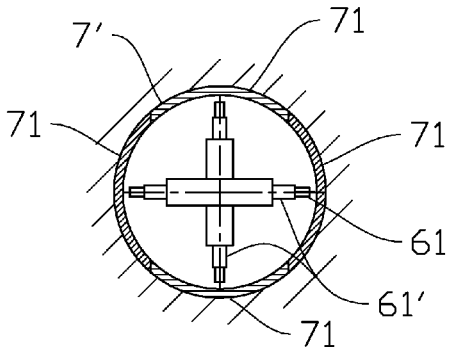
FIG. 20 shows four cross sections of the gripping means of the apparatus in the casing, where cross section a shows that the circumference of the pipe is divided into four pipe sections, cross section b shows one gripping pin in engagement with each of the four pipe sections, cross section c shows two diametrically opposite pipe sections withdrawn and cross section d shows the two remaining pipe sections withdrawn.

FIG. 20*a* shows the gripping pins 61 before they are activated.

Figure 20B:
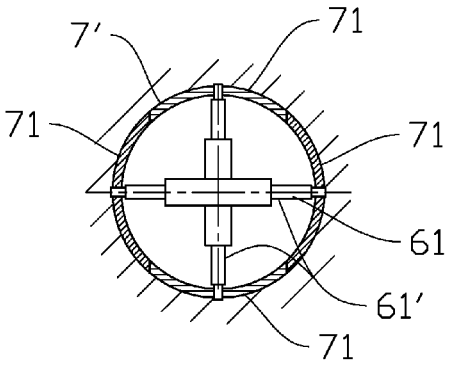

FIG. 20*b* shows the gripping pins 61 in active, extended position, where each gripping pin 61 is led into secure engagement with one of the four pipe sections 71.

Figure 20C:
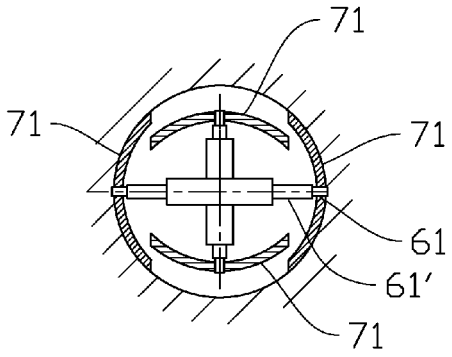

FIG. 20*c* shows the same as FIG. 20*b*, but after two opposite gripping pins 61 have been retracted, but where the gripping pins 61 are still in secure engagement with their respective pipe sections 71.

Figure 20D:
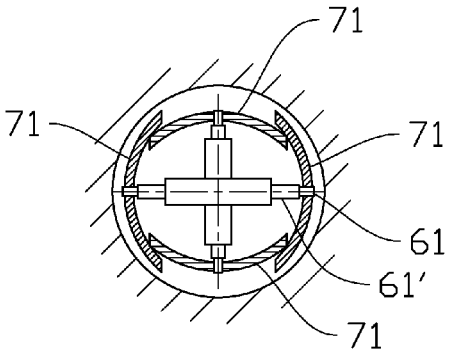

FIG. 20*d* shows the same as FIG. 20*c*, but after the two remaining gripping pins 61 are also retracted. The cut casing 7' has now been contracted sufficiently for being pulled out of the well as it may now pass through the intact casing 7 above the upper peripheral cut. Alternatively the cut pipe sections 71 may be dropped down into the collecting container 10 as shown in the FIGS. 12-19.

The invention claimed is:

1. An apparatus for cutting and pulling of a casing in a well, where the apparatus comprises:

a housing connected to a wired connection;

a cutting tool arranged in connection with the housing, where said cutting tool is rotatable around a longitudinal axis of the housing and arranged to be able to provide at least one cut-out in the wall of the casing and to be able to cut the casing; and a holding device for controlled holding of the housing in the casing;

wherein the apparatus is provided with at least one radially displaceable gripping means arranged to go into engagement with the at least one cut-out in the wall of the casing.

2. The apparatus in accordance with claim 1, where the cutting tool is displaceable relative to the housing in the longitudinal direction of the housing.

3. The apparatus in accordance with claim 1, where the cutting tool is further provided with a pressure intensifier located in the well.

4. The apparatus in accordance with claim 3, where the pressure intensifier is located inside of the housing.

5. The apparatus in accordance with claim 1, where the holding device comprises at least two radially displaceable holding pins arranged to be able to protrude from a portion of the housing.

6. The apparatus in accordance with claim 1, where at least one set of radially displaceable holding pins which are arranged to be able to protrude from a portion of the housing, constitutes the holding device, one set consisting of two radially displaceable holding pins.

7. The apparatus in accordance with claim 1, where the at least one gripping means is constituted by one or more radially displaceable gripping pins arranged to be able to protrude from a portion of the housing.

8. The apparatus in accordance with claim 7, where one or more radially displaceable gripping pins are distributed along the circumference of the housing and the circumference of the extension of the housing.

9. The apparatus in accordance with claim 8, where the at least one gripping means protruding from an extension of the housing comprises at least one set of gripping pins where one set comprises four gripping pins.

10. The apparatus in accordance with claim 1, the at least one gripping means being constituted of one or more radially displaceable gripping pins arranged in an end portion of radially displaceable arms protruding from an extension of the housing.

11. The apparatus in accordance with claim 10, where a collecting container is arranged below the gripping pins in the extension of the housing.

12. The apparatus in accordance with claim 1, the housing being further provided with an axially displaceable portion.

13. The apparatus in accordance with claim 12, where the holding device comprises at least two sets of radially displaceable holding pins, at least one set of holding pins being arranged on either side, in the longitudinal direction, of the axially displaceable portion.

14. The apparatus in accordance with claim 1, where the apparatus provided with two or more cutting tools arranged in series in the longitudinal direction of the well.

15. A method for cutting and pulling of a casing means of an apparatus comprising a housing connected to wired connection;

a cutting tool arranged in connection with the housing, where said cutting tool is rotatable around a longitudinal axis of the housing and arranged to be able to provide at least one cut-out in the wall of the casing and to be able to cut the casing; and a holding device for controlled holding of the housing in the casing;

wherein the apparatus is provided with at least on radially displaceable gripping means arranged to go into engagement with the at least one cut-out in the wall of the casing, the method comprising:

bring the apparatus down into the well;

positioning the apparatus in order to carry out a first cut;

carrying out the first cut:

positioning the apparatus in order to carry out a second cut;

carrying out the second cut; one of the first cut and the second cut comprising cutting of the casing;

bringing at least one gripping means into engagement with at least one of the first and the second cut; and pulling the cut casing out of the well by means of the apparatus.

16. The method in accordance with claim 15, where the first cut comprises providing at least one cut-out the wall portion of the casing and a second cut comprises providing a cut of the casing.

17. The method in accordance with claim 15, where the positioning of the apparatus in order to make the at least one second cut is provided by displacing a cutting tool relative to a housing comprising the apparatus, while the housing is kept from movement in the casing.

18. The method in accordance with claim 15, where the positioning of the apparatus in order to make the at least one second cut is provided by displacement of the apparatus in the casing.

19. The method in accordance with claim 15, further comprising providing the apparatus with an axially displaceable portion which by means of a driving means is arranged to be able to provide elongation and shortening of the apparatus, and with a holding device comprising at least two sets of radially displaceable holding pins where the pins of at least one set of holding pins are arranged on either side, in the longitudinal direction, of the axially displaceable portion, and with a control apparatus arranged to be able to control each of the sets of holding pins alternately abutting the inner wall of the casing as the displaceable portion is elongated or shortened.

20. A method for cutting and pulling of a casing by means of the apparatus comprising a housing connected to a wired connection;

a cutting tool arranged in connection with the housing, where said cutting tool is rotatable around a longitudinal axis of the housing and arranged to be able to provide at least one cut-out in the wall of the casing and to able to cut the casing; and a holding device for controlled holding of the housing in the casing;

wherein the appartus is provided with at least one radially displaceable gripping means arranged to go into engagement with the at least one cut-out in the wall of the casing, the method comprising:

bringing the apparatus down into the well;

positioning the apparatus in order to carry out at least one first cut;

carrying out the at least one first cut;

positioning the apparatus in order to carry out at least one second cut;

to carrying out the at least one second cut; one of the first cut and the second cut comprising peripheral cutting of the casing and the second of the at least one first cut and the at least one second cut comprises longitudinal cutting of the casing;

positioning the apparatus in order to carry out at least two third cuts;

carrying out the at least two third cuts; the at least two third cuts comprising cutting of at least two fingers;

bringing the at least two gripping means into secure engagement with the at least two third cuts by pushing the at least two fingers out and bringing the gripping means into engagement with the edge of the cut casing;

retracting the at least two gripping means while the locked engagement with the walls of the casing is maintained so that the walls of the casing are contracted as well;

pulling the cut casing out of the well by means of the apparatus.

21. The method in accordance with claim 20, where the apparatus is further provided with a collecting container below the gripping means and where the gripping means after pulling in of the cut casing, is released from said casing whereby the cut casing is falling down into said collecting container.

* * * * *

UNITED STATES PATENT AND TRADEMARK OFFICE

CERTIFICATE OF CORRECTION

PATENT NO. : 9,194,200 B2
APPLICATION NO. : 14/351795
DATED : November 24, 2015
INVENTOR(S) : Leif Orstad It is certified that error appears in the above-identified patent and that said Letters Patent is hereby corrected as shown below:

In the Claims

Claim 14, column 13, line 26: insert --is-- between the words “apparatus” and “provided”.

Claim 15, column 13, line 28: insert --by-- between the words “causing” and “means”.

Claim 15, column 13, line 38: delete “on”, insert --one--.

Claim 15, column 13, line 43: delete “bring”, insert --bringing--.

Claim 15, column 13, line 45: delete “:”, insert --;--.

Claim 16, column 13, line 54: insert --in-- between the words “cut-out” and “the”.

Claim 16, column 13, line 55: insert --,-- after the word “casing”.

Claim 20, column 14, line 37: delete “to” before the word “carrying”.

Signed and Sealed this
Fifth Day of April, 2016

Michelle K. Lee

Michelle K. Lee
*Director of the United States Patent and Trademark Office*